US005139353A

United States Patent [19]

Ota

[11] Patent Number: 5,139,353

[45] Date of Patent: Aug. 18, 1992

[54] PRINTER HAVING A SINGLE PLATEN WITH MULTIPLE PAPER FEED

[75] Inventor: Yukio Ota, Tokyo, Japan

[73] Assignee: Oki Electric Industry Co., Ltd., Tokyo, Japan

[21] Appl. No.: 768,467

[22] Filed: Sep. 30, 1991

Related U.S. Application Data

[63] Continuation of Ser. No. 457,169, Dec. 26, 1989, abandoned.

[30] Foreign Application Priority Data

Dec. 30, 1988 [JP] Japan ..... 63-331487

[51] Int. Cl.[5] ..... B41J 11/51

[52] U.S. Cl. ..... 400/584; 400/595; 400/607

[58] Field of Search ..... 400/584, 585, 587, 595, 400/599, 607, 625, 636, 586, 588

[56] References Cited

U.S. PATENT DOCUMENTS

| | | | |
|---|---|---|---|
| 4,011,811 | 3/1977 | Kodis | 400/584 |
| 4,167,345 | 9/1979 | Englund et al. | 400/588 |
| 4,205,770 | 6/1980 | Wojdyla | 400/608.1 |
| 4,229,113 | 10/1980 | Anderson et al. | 400/596 |
| 4,395,152 | 7/1983 | Hendrischk | 400/588 |
| 4,403,878 | 9/1983 | Hosogaya | 400/585 |
| 4,415,287 | 11/1983 | Wincent | 400/588 |
| 4,448,559 | 5/1984 | Matsuda et al. | 400/637.4 |
| 4,589,784 | 5/1986 | Valle et al. | 400/584 |

FOREIGN PATENT DOCUMENTS

| | | | |
|---|---|---|---|
| 0029200 | 5/1981 | European Pat. Off. . | |
| 0162405 | 11/1985 | European Pat. Off. . | |
| 2252925 | 6/1975 | France . | |
| 0155079 | 9/1984 | Japan | 400/584 |

OTHER PUBLICATIONS

"Wide Paper Feed for Narrow Tape Printers", R. D. Mathews, IBM Technical Disclosure Bulletin, vol. 23, No. 10, Mar. 1981, pp. 4796–4797.

*Primary Examiner*—Clifford D. Crowder
*Assistant Examiner*—John S. Hilten
*Attorney, Agent, or Firm*—Wenderoth, Lind & Ponack

[57] ABSTRACT

A printer capable of selective printing of a relatively narrow uncut sheet or a relatively wide cut sheet has a paper feeding apparatus for such selective printing. The paper feeding apparatus includes an uncut sheet feeding mechanism for feeding the uncut sheet from a roll of the uncut sheet to a gap formed between a printing head and a platen, and a cut sheet feeding mechanism for feeding the cut sheet to a gap between the printing head and the uncut sheet on the platen. The uncut sheet feeding mechanism and the cut sheet feeding mechanism are selectively driven to feed either the uncut sheet or the cut sheet.

8 Claims, 11 Drawing Sheets

PRINTER HAVING A SINGLE PLATEN WITH MULTIPLE PAPER FEED

This application is a continuation of now abandoned application, Ser. No. 07/457,169, filed Dec. 26, 1989.

BACKGROUND OF THE INVENTION

The present invention relates to a printer, such as one for an electronic cash register (hereinafter referred to as ECR) and particularly to an improvement in a paper feeding apparatus in a printer enabling selective printing on either an uncut (continuous) sheet or a cut sheet.

Conventionally, ECR printers contain two parallel rolls of uncut sheets with their unwound parts placed over a platen. One of the rolls is for receipt and the other roll is for journal. The two rolls of the uncut sheets are fed by feed rollers, and printing is conducted by a printing head which is mounted on a carriage, so that the tip of the printing head is spaced by a gap from the platen. The carriage is moved in parallel with the axis of the platen so that the printing head scans laterally. The printed part of the uncut sheet for receipt is severed for handling to a customer as a receipt. The printed part of the uncut sheet for journal is wound on a reel as a record or a journal.

An example of a paper feeding mechanism for such an ECR printer is shown in FIG. 13 and FIG. 14. A carriage 1 carries an ink ribbon cassette 2 and a printing head 3 and is guided by both a guide shaft 4 and a guide rail 5 to move in parallel with the axis of a first platen 7 and the axis of a second platen 10. The first and the second platens 7 and 10 are disposed side by side and are capable of rotation independently of each other. An uncut sheet 6 for a receipt is placed over the first platen 7 and is held between the first platen 7 and a pressure roller 7*a*. A cutter 8 is arranged above the first platen 7 for severing the receipt sheet 6. A journal sheet 9 is held between the second platen 10 and a pressure roller 10*a* and is guided by a guide bracket 11 and then wound by a take-up reel (not shown) at a rear portion of the printer. A platen gear 12 is fixed to one end of the first platen 7, and is coupled to a stepping motor 16 via an idle gear 14. Similarly, a platen gear 13 is fixed to one end of the second platen 10, and is coupled to a stepping motor 17 via an idle gear 15. To feed either the receipt sheet 6 or the journal sheet 9 the corresponding one of the stepping motors 16 and 17 is actuated. To feed both the receipt sheet 6 and the journal sheet 9 simultaneously, both of the stepping motors 16 and 17 are actuated.

The conventional ECR printers are designed to feed and print cut sheets, and thus cannot feed previously cut sheets, and also is not suitable for printing on a previously cut sheet. One reason for this is that a cut sheet is normally wider than the uncut sheet for receipt or journal, and two platens are placed side by side with a gap therebetween, although such gap may be very small. Moreover, because the two platens must be rotated independently of each other, the structures for supporting them are complicated. Furthermore, the electric power supply must have a larger capacity so that two stepping motors can be energized simultaneously.

SUMMARY OF THE INVENTION

Accordingly, an object of the present invention is to enable selective feeding of and printing on either a relatively narrow uncut sheet or a relatively wide cut sheet.

Another object of the invention is to enable selective feeding of and printing on either at least one of two relatively narrow uncut sheets or a relatively wide cut sheet.

A printer according to the invention for selectively printing on at least one uncut sheet or a cut sheet comprises:

a platen;

a printing head confronting the platen and spaced by a gap;

a motor;

an uncut sheet feeding mechanism for selectively feeding or stopping at least one uncut sheet from a roll of uncut sheet to said gap between said printing head and said platen;

said uncut sheet feeding mechanism being driven by said motor to feed the uncut sheet;

a cut sheet feeding mechanism for feeding a cut sheet to a gap between said printing head and said uncut sheet on said platen;

said cut sheet feeding mechanism being driven by said motor to feed the cut sheet; and control means for controlling said uncut sheet feeding mechanism and said cut sheet feeding mechanism to cause either one of them to feed and the other not to feed.

DETAILED DESCRIPTION OF THE PREFERRED EMBODIMENTS

An embodiment of the invention will now be described with reference to FIG. 1 to FIG. 10. The printer of this embodiment is capable of printing on (a) a receipt sheet only, (b) a journal sheet only, (c) both a receipt sheet and a journal sheet, or (d) previously cut or precut sheets. Each of the receipt and journal sheets are in the form of a roll of uncut sheet disposed within the housing of the printer. The cut sheets are manually inserted from outside of the housing of the printer.

Figure 1:
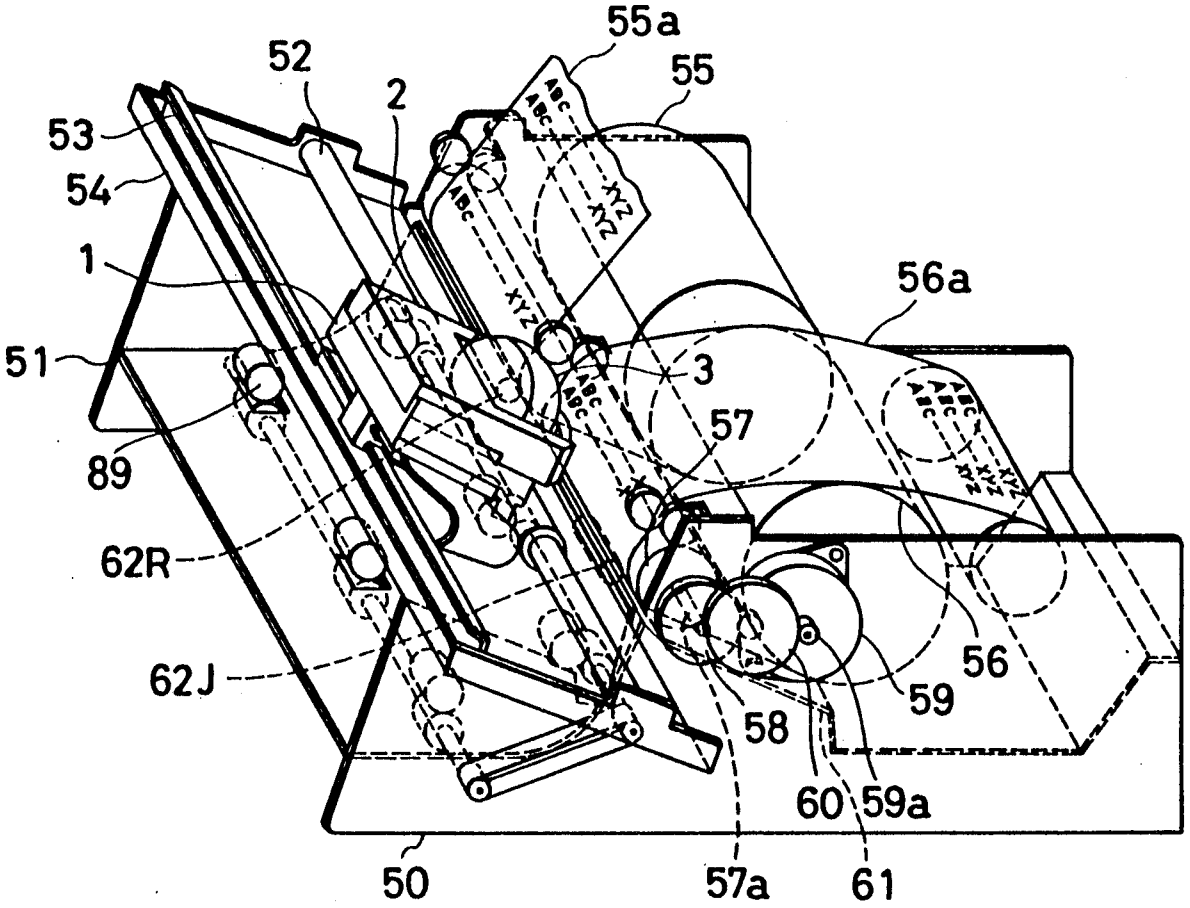
FIG. 1 is a schematic perspective view of a printer constructed according to the present invention.
Figure 2:
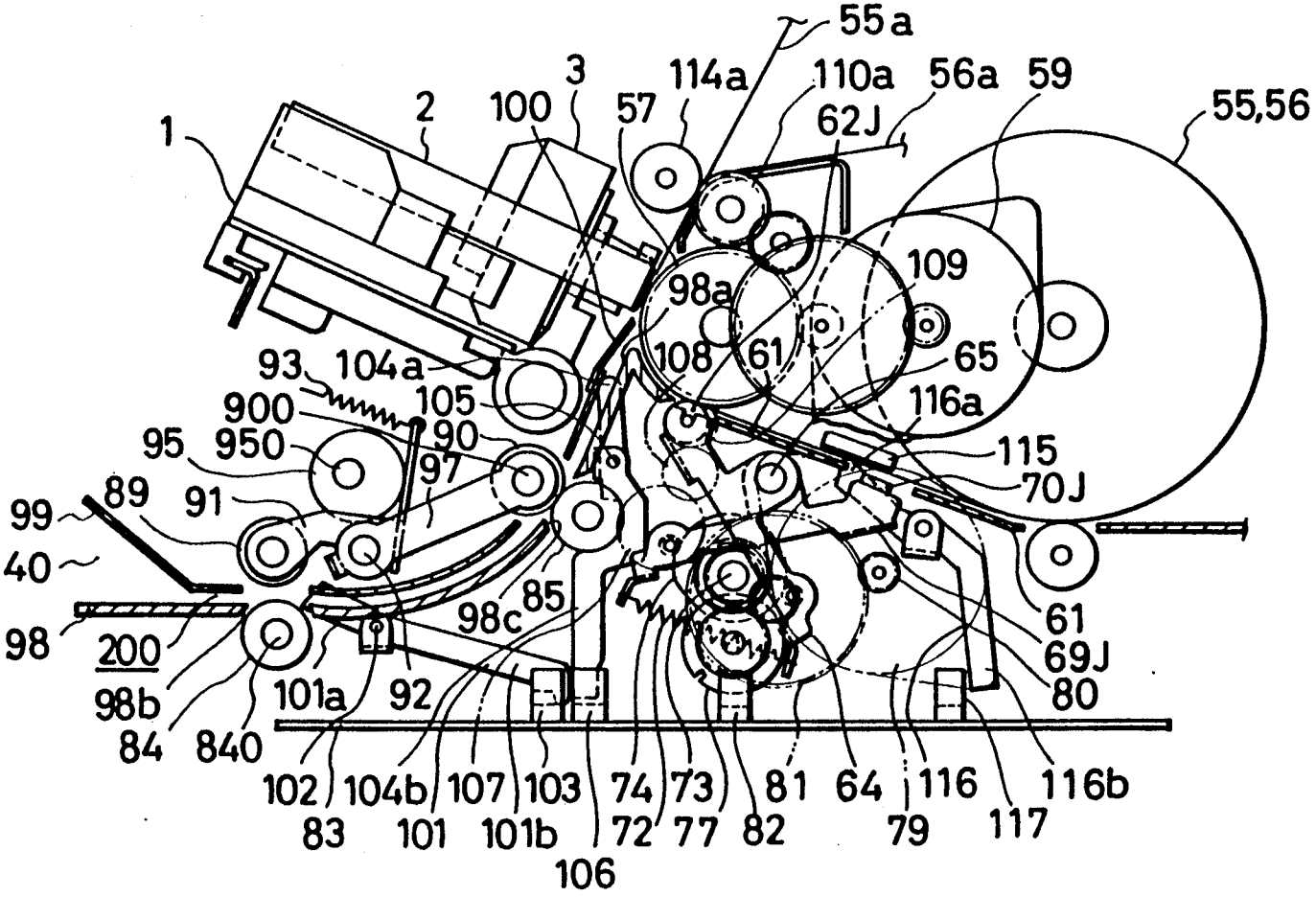
FIG. 2 is an enlarged schematic side view, partly in section, of the printer in FIG. 1.

Referring first particularly to FIG. 1 and FIG. 2, the printer of this embodiment is an ECR printer having right and left vertical side frames 50 and 51 which are parallel with each other. The right and left side frames are bridged by a laterally extending supporting frame 54. A carriage guide shaft 52 and a carriage guide rail 53 are mounted to the supporting frame 54 to extend in parallel with each other. A conventional carriage 1 is slidably mounted on the carriage guide shaft 52 and the carriage guide rail 53. A printing head 3 is mounted on the carriage 1 such that the tip of the printing head 3 confronts a platen 57, with a gap therebetween. An ink ribbon cassette 2 is also mounted on the carriage 1 such that an exposed part of an ink ribbon is interposed between the printing head 3 and the platen 57.

A roll of receipt sheet 55 and a roll of journal sheet 56 are rotatably supported inside both the right side frame 50 and the left side frame 51 at the rear of (to the right of, as seen in FIG. 2) the platen 57. Both unwound part **55*a* of the receipt sheet 55 and unwound part 56*a* of the journal sheet 56 pass below the platen 57 and then turn upwards to pass between the platen 57 and the printing head 3. Then, the unwound part 56*a* of the journal sheet 56** extends backwards and is wound by a take-up reel (not shown) driven by a motor (also, not shown) provided at a rear portion (the right side, as seen in FIG. 2) of the printer.

Figure 10:
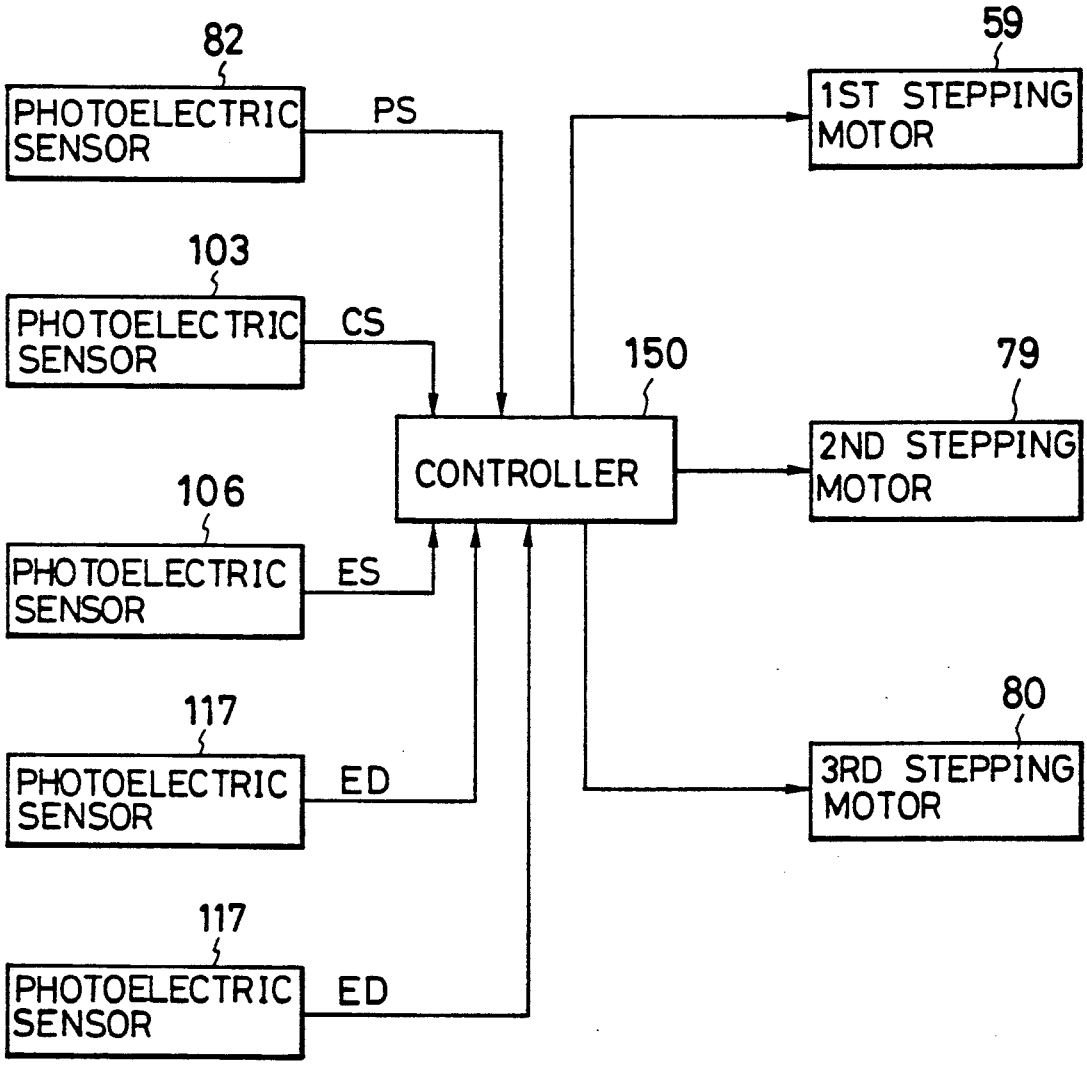
FIG. 10 is a block diagram of an electric control circuit used in the printer in FIG. 1.

An uncut sheet guide bracket 61 is mounted with opposite sides thereof adjacent to the right side frame 50 and the left side frame 51, and forms an ascending slope toward the front (the left as seen in FIG. 2). The guide bracket 61 guides the receipt sheet 55 and the journal sheet 56 up to a location near the printing head 3. A beam 115 spans between the right side frame 50 and the left side frame 51 and is located above the uncut sheet guide bracket 61 and is spaced therefrom by a gap. Both the receipt sheet 55 and the journal sheet 56 pass through this gap. A pair of uncut sheet detection levers 116 (only one of which is shown in FIG. 2) are disposed at the passage for the receipt sheet and the passage for the journal sheet, respectively, and are mounted with respect to the lower face of the uncut sheet guide bracket 61 such that they can rotate about a horizontal axis. A first end **116*a* of each paper end detection lever 116 passes through an opening of the uncut sheet guide bracket 61 to contact the beam 115 for detecting presence of the receipt sheet 55 or the journal sheet 56. A second end 116*b* of each lever 116 is arranged to move into a space between a light-emitting element and a photosensitive element of a photoelectric sensor 117. When the second end 116*b* is in the space between the light-emitting element and the photosensitive element, it interrupts the path of light from the light-emitting element to the photosensitive element. Accordingly, movement of the second end 116*b* into or out of the space between the light-emitting element and the photosensitive element causes a variation in an electrical signal, and is thereby detected. In other words, the presence of the uncut sheet which moves the detection lever 116 can be detected. The photoelectric sensor 117 may be mounted on a control printed-circuit board 83, and is electrically connected to other circuit components, such as a controller 150**, as shown in FIG. 10.

The platen 57 has a shaft **57*a* fixed to and coaxial with the platen 57, and a platen gear 58 is secured to the right end of the shaft 57*a*. A first stepping motor 59 is mounted to the right side frame 50, and a motor gear 59*a* which is secured to an output shaft of the first stepping motor 59 engages the platen gear 58 through an idle gear 60. The idle gear 60 is rotatably supported on the right side frame 50**.

Figure 3:
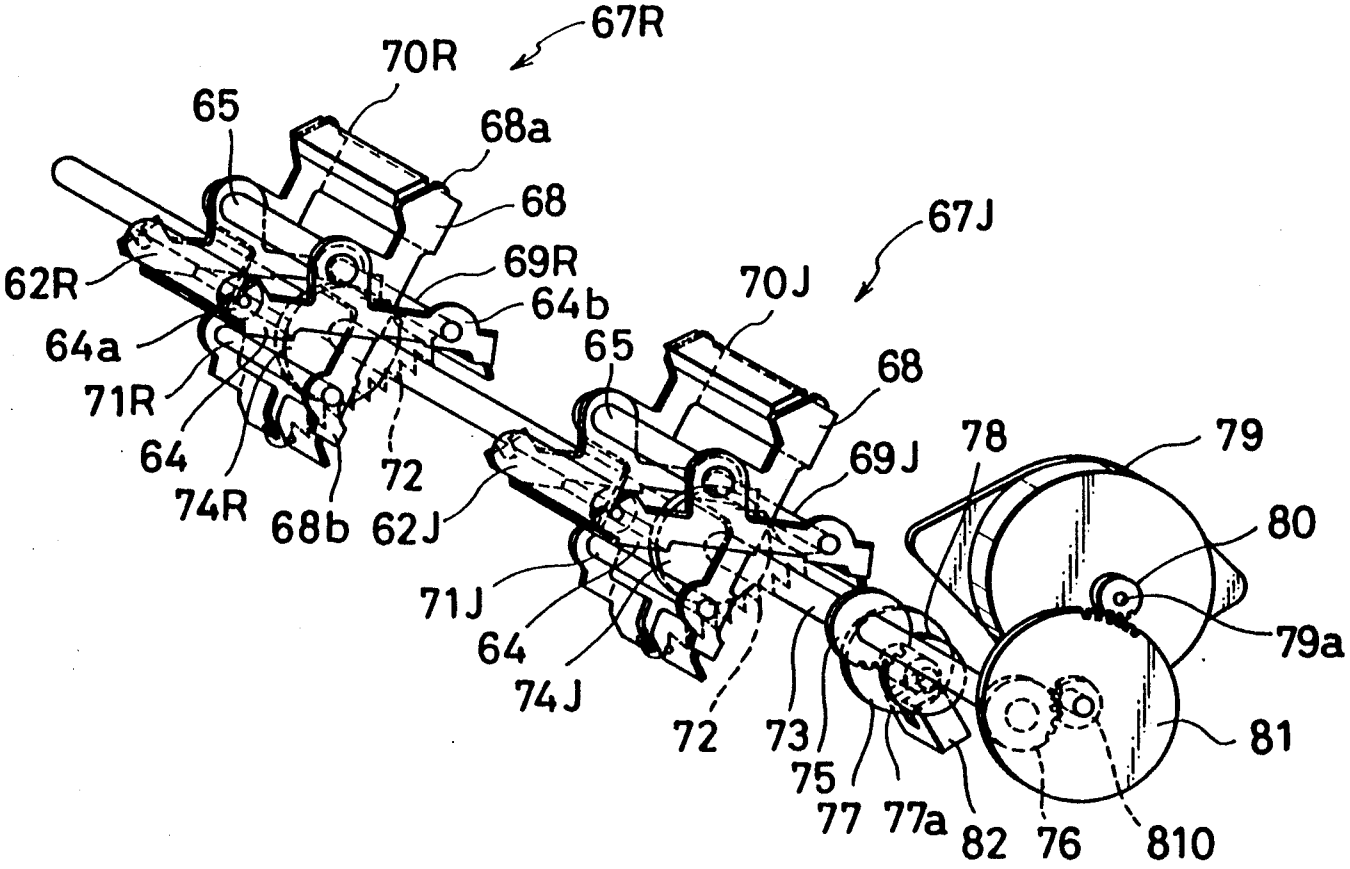
FIG. 3 is an enlarged perspective view of uncut sheet feed/stop mechanisms shown in FIG. 1.

A receipt tape feed/stop mechanism 67R and a journal tape feed/stop mechanism 67J are disposed below the platen 57. They are best illustrated in FIG. 3. The receipt tape feed/stop mechanism 67R includes a receipt tape pressure roller 62R, and a pair of, i.e., right and left, generally flat pressure roller arm brackets 64, and the receipt tape pressure roller 62R is rotatably supported on first ends **64*a* of the pressure roller arm brackets 64. The pressure roller arm brackets 64 are rotatably mounted at intermediate portions thereof to opposite ends of a support shaft 65, which in turn is supported on the tape guide bracket 61, by means not shown. A cam follower shaft 69R is mounted at second ends 64*b* of the pressure roller arm brackets 64**.

A pair of, i.e., right and left, generally flat clamp arm brackets 68 are rotatably mounted at intermediate portions thereof to opposite ends of the support shaft 65. The clamp arm brackets 68 are adjacent to and in contact with the respective pressure roller arm brackets 64, and are rotatable relative to the pressure roller arm brackets 64. A friction pad 70R is mounted to first ends **68*a* of the clamp arm brackets 68. A cam follower shaft 71R is mounted to second ends 68*b* of the clamp arm brackets 68**.

A tension spring 72 connects the second end **64*b* of the right pressure roller arm bracket 64 with the second end 68*b* of the right clamp arm bracket 68, so that the second end 64*b* of the right pressure roller arm bracket 64 and the second end 68*b* of the right clamp arm bracket 68** are pulled or biased toward each other.

The journal tape feed/stop mechanism 67J is similar to the receipt tape feed/stop mechanism 67R, and the members thereof similar to those of the receipt tape feed/stop mechanism 67R are given similar reference numerals and description thereof is omitted. The journal tape pressure roller 62J, the friction pad 70J, the cam follower shafts 71J and 69J, and the cam 74J are similar to the receipt tape pressure roller 62R, the friction pad 70R, the cam follower shafts 71R and 69R, and the cam 74R, but are provided with different reference suffixes (with "R" being replaced by "J"), and for the sake of convenience the description of the operation thereof will be given later.

The second end **64*b* of the right pressure roller arm bracket 64, the second end 68*b* of the right clamp arm bracket 68, and the tension spring 72 of each of the supporting mechanism 67R and journal feed/stop mechanism 67J define a triangular space, through which a first cam shaft 73 passes. Ends of the first cam shaft 73 are rotatably mounted to the right side frame 50 and the left side frame 51. A pair of feed/stop control cams 74R and 74J are mounted on first cam shaft 73**.

Also mounted on the first cam shaft 73 are a slit disk driving gear 75 and a cam shaft gear 76.

The feed/stop control cam 74R is secured to the first cam shaft 73 in such a manner that it comes into contact with the cam follower shafts 71R and 69R at positions diametrically opposite with respect to the axis of the cam shaft 73, as schematically illustrated in FIG. 4A to FIG. 4D. The feed/stop control cam 74J is secured to the first cam shaft 73 in such a manner that it comes into contact with cam follower shafts 71J and 69J at positions diametrically opposite with respect to the axis of the cam shaft 73, as schematically illustrated in FIG. 4A to FIG. 4D.

The feed/stop control cams 74R and 74J are typically eccentric cams, but for simpler understanding, they are illustrated to have an elevated part and a recessed part each extending about 180° and discontinued at steps to offer an easier understanding of the concept of the function of the cam. The feed/stop control cams 74R and 74J have identical contours, except that their contours are 90° out of phase relative to each other.

When the cam follower shafts 71R, 71J, 69R and 69J confront the elevated part of the respective cam, they are pushed by such elevated part. When the cam follower shafts 71R, 71J, 69R or 69J confront the recessed part of the respective cam, they are not pushed.

When the cam follower shaft 71R or 71J on the clamp arm brackets 68 is pushed by the elevated part of the respective cam, the friction pad 70R or 70J on the clamp arm brackets 68 is separated from the beam 115. Simultaneously, by virtue of the tension spring 72, the lower end of the corresponding pressure roller arm bracket 64 is pulled, so that the pressure roller arm bracket 64 is rotated clockwise as seen in FIG. 3, and the pressure roller 62R or the 62J is pressed against the platen 57. As a result, the receipt sheet or the journal sheet is fed.

When the cam follower shaft 69R or 69J on the pressure roller arm brackets 64 is pushed by the elevated part of the respective cam, the pressure roller 62R or 62J on the pressure roller arm brackets 64 is separated from the platen 57. Simultaneously, by virtue of the tension spring 72, the lower end of the corresponding clamp arm bracket 68 is pulled, so that the clamp arm bracket 68 is rotated counterclockwise as seen in FIG. 3, and the friction pad 70R or 70J is pressed against the beam 115. As a result, further feeding of the receipt sheet or the journal sheet is halted or stopped.

The cam shaft 73 is driven by a stepping motor, to be described later, to assume either of four positions 90° spaced apart from each other. FIG. 4A, FIG. 4B, FIG. 4C and FIG. 4D show the states in which the cam shaft is at first, second, third and fourth positions, respectively. The following TABLE 1 shows whether each of the cam follower shafts 71R, 71J, 69R and 69J are pushed (ON) or not pushed (OFF) at the four positions. The states of the cams and the feed/stop mechanisms in the four positions are illustrated in the diagrams indicated at the right side of the TABLE 1.

TABLE 1

Figure 4A:
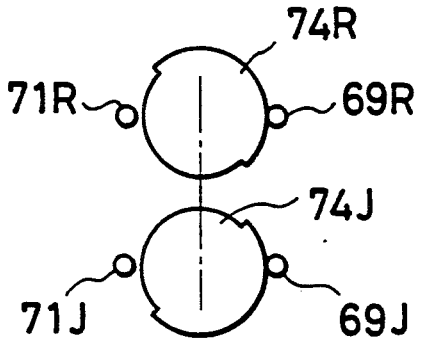
FIG. 4A to FIG. 4D are schematic diagrams showing the operation of feed/stop control cams at four positions.
Figure 4B:
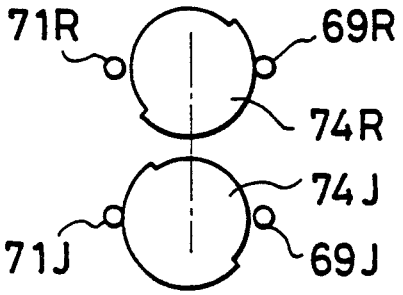
Figure 4C:
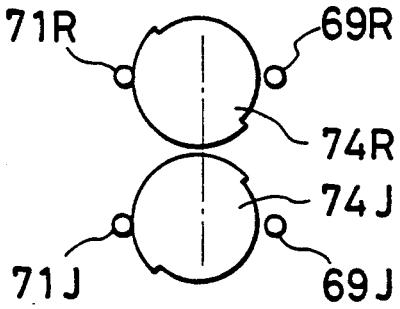
Figure 4D:
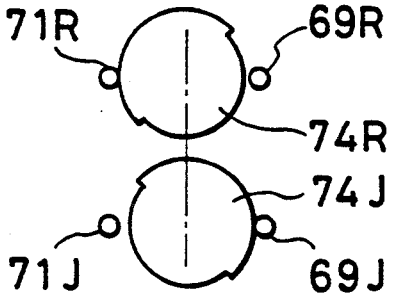
Figure 6A:
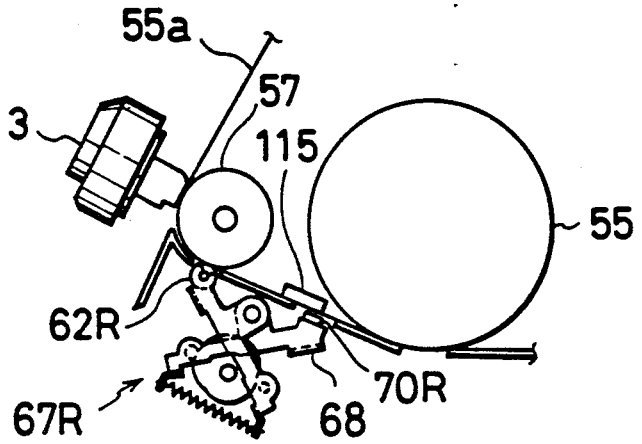
FIG. 6A and FIG. 6B are side views, on a reduced scale, of the uncut sheet feed/stop mechanisms when the feed/stop control cams are placed in positions shown in FIG. 4B.
Figure 6B:
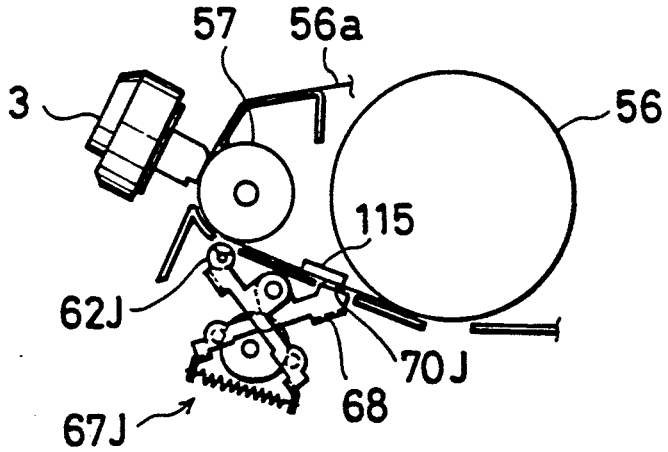
Figure 7A:
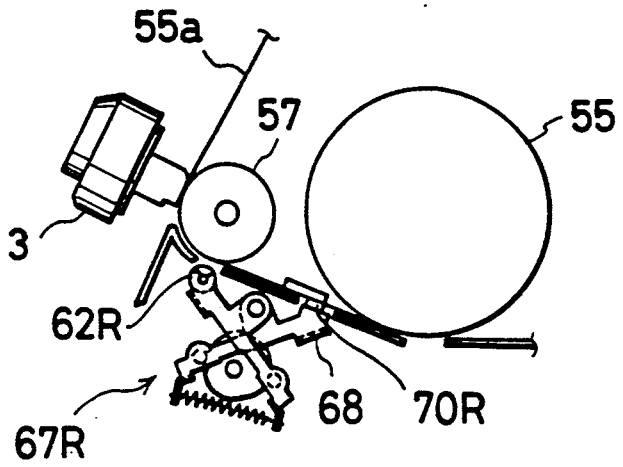
FIG. 7A and FIG. 7B are side views, on a reduced scale, of the uncut sheet feed/stop mechanisms when the feed/stop control cam are placed in positions shown in FIG. 4D.
Figure 7B:
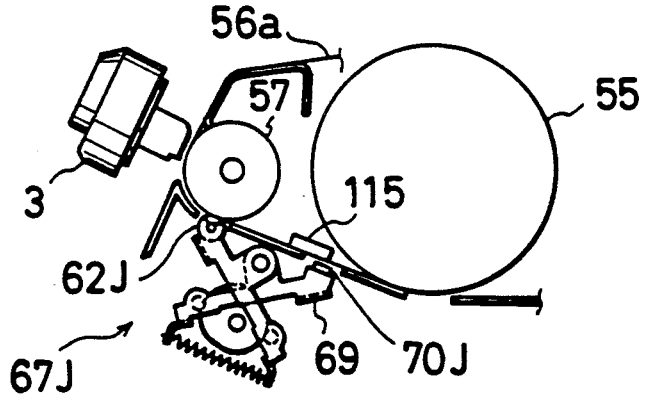
Figure 8:
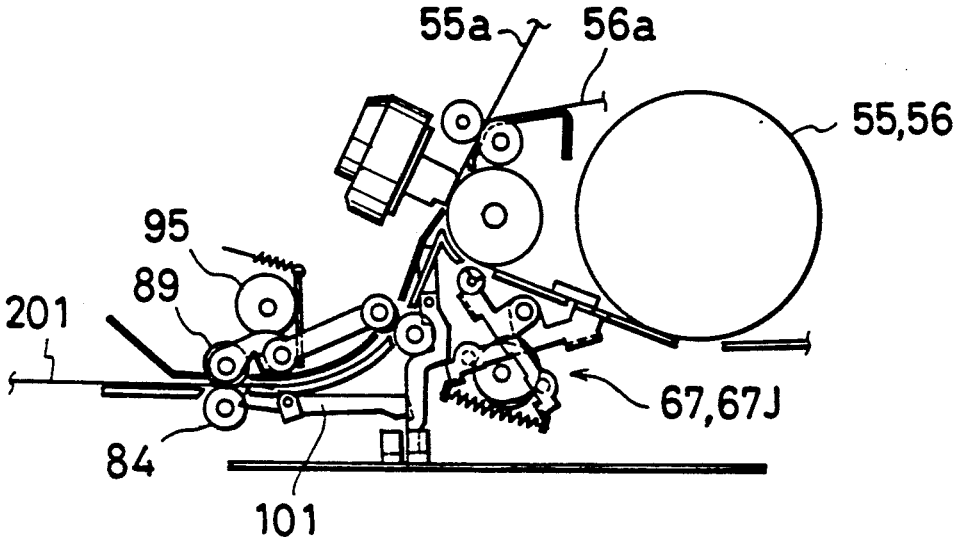
FIG. 8 is a side view, on a reduced scale, of the cut sheet feeding mechanism and the uncut sheet feed/stop mechanisms of FIG. 2 when a cut sheet is inserted into the cut sheet feeding mechanism.
Figure 9:
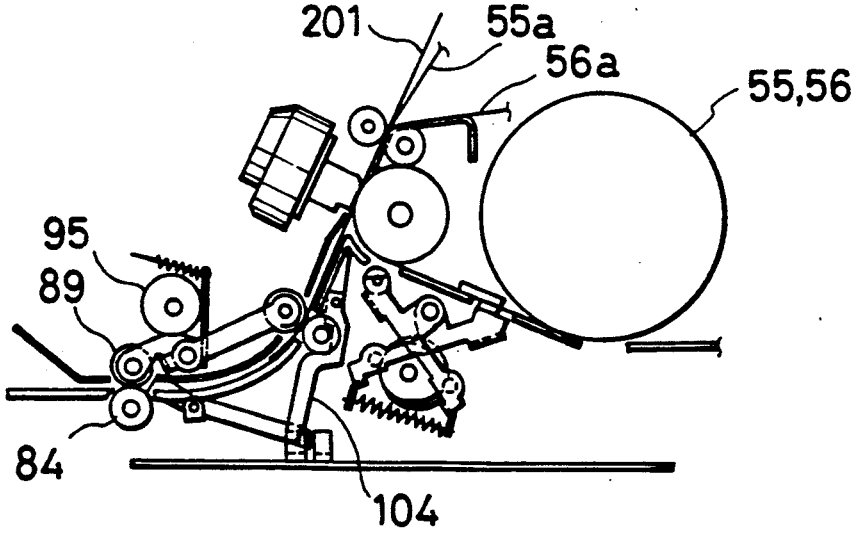
FIG. 9 is a side view, on a reduced scale, of the cut sheet feeding mechanism of FIG. 2 when printing on the cut sheet is completed.

| POSITION | 71R | 71J | 69R | 69J | RECEIPT | JOURNAL | |
|---|---|---|---|---|---|---|---|
| 1st | ON | ON | OFF | OFF | FED | FED | FIG. 4C/FIG. 2 |
| 2nd | ON | OFF | OFF | ON | FED | HALTED | FIG. 4D/FIGS. 6A, 6B |
| 3rd | OFF | OFF | ON | ON | HALTED | HALTED | FIG. 4A/FIG. 9 |
| 4th | OFF | ON | ON | OFF | HALTED | FED | FIG. 4B/FIGS. 7A, 7B |

The slit disk driving gear 75 engages a driven gear 78 having an equal number of teeth. A slit disk 77 is secured to the driven gear 78, and has a radially extending slit **77*a*. Thus, the slit disk 77 is rotated synchronously with the first cam shaft 73. The slit disk 77 with the slit 77*a* cooperates with a photoelectric sensor 82. Specifically, the peripheral part of the slit disk 77 passes between a light-emitting element and a photosensitive element of the photoelectric sensor 82, and passage of the slit 77*a* is detected by the photoelectric sensor 82. A signal PS indicating the detection of the passage of the slit 77*a* is supplied to the controller 150 and is used for control of the position of the cams 74R and 74J. The photoelectric sensor 82 is mounted on control printed-circuit board 83**.

The cam shaft gear 76 meshes with a gear 810, which is coaxially secured to an idle gear 81. The idle gear 81 is rotatably mounted to a casing of a second stepping motor 79, which is secured to the right side frame 50.

A cut sheet feeding mechanism of the printer will now be described with reference to FIG. 2 and FIG. 5. The cut sheet feeding mechanism is for feeding cut sheets that have been manually inserted into an opening 40 by the operator from the front side (left side as seen in FIG. 1 and FIG. 2). The cut sheet feeding mechanism includes an upwardly curved lower guide 98 and an upwardly curved upper guide 99 which is located above the lower guide 98. The lower guide 98 and upper guide 99 are secured to the right side frame 50 and the left side frame 51 and spaced from each other by a predetermined distance to form a cut sheet traveling passage 200. An upper end portion **98*a* of the lower guide 98 is continuous with sloping uncut sheet guide bracket 61 which acts as a guide for the receipt sheet 55 and the journal sheet 56**.

The lower guide 98 and the uncut sheet guide bracket 61 may be formed by bending a continuous sheet. The upper guide 99 is provided at its upper edge with a resilient paper pressure plate 100 for resiliently directing a cut sheet or the uncut sheet toward the platen 57 so as to guide the cut sheet or the uncut sheet to travel along the platen 57.

A first main feed roller shaft 840 transversely passes below the lower guide 98 and has three main feed rollers 84 coaxially fixed to the shaft 840. The first main feed roller shaft 840 is rotatably mounted at its opposite ends to the right side frame 50 and the left side frame 51. The main feed rollers 84 partly pass through corresponding openings **98*b* of the lower guide 98 and project upwardly from the lower guide 98. In addition, a second main feed roller shaft 850 extends at the back of (the right side of, as seen in FIG. 2) the lower guide 98 and also has three second main feed rollers 85 coaxially fixed on it. The opposite ends of the second main feed roller shaft 850 are rotatably mounted to the right side frame 50 and the left side frame 51. The second main feed rollers 85 slightly project forwardly of the lower guide 98 through corresponding openings 98*c* formed through the lower guide 98. A toothed timing belt pulley 86 is secured to a right end of the first main feed roller shaft 840. Similarly, a toothed timing belt pulley 87 is secured to a right end of the second main feed roller shaft 850. A timing belt 88 extends over and between the toothed timing belt pulley 86 and the toothed timing belt pulley 87. The second main feed roller shaft 850 is provided at its right end with a driven gear 852, which engages the platen gear 58 through a gear train including an idle gear 107, an idle gear 108 and an idle gear 109**.

A pair of bell cranks 91 are rotatably mounted at opposite end portions of a support shaft 92, which is secured at its opposite ends to the right side frame 50 and the left side frame 51 and extends above the upper guide 99. A first arm 91*a* of each bell crank 91 rotatably supports a corresponding end of a sub-feed roller shaft 890. Three sub-feed rollers 89 are coaxially fixed on the sub-feed roller shaft 890 so that they face corresponding main feed rollers 84. A second arm 91*b* of each bell crank 91 is connected to the right side frame 50 or the left side frame 51 through a biasing tension spring 93. Each of the biasing tension springs 93 biases the corresponding bell crank 91 to turn in the counterclockwise direction as seen in FIG. 5.

The bell cranks 91 are actuated by a cut sheet feeder cam mechanism 94, which includes a pair of cut sheet feeder cams 95 secured to a cam shaft 950. The cam shaft 950 is provided at one end thereof with a gear 96 which is connected to a third stepping motor 80 (FIG. 10) electrically connected to the controller 150. The cams 95 are eccentric cams and the largest radius portion of each cam 95 is shown to be in abutment with the respective second arm 91*b*, so that sub-feed rollers 89 are spaced from respective main feed rollers 84 by a predetermined distance.

A pair of feed roller arms 97 are rotatably supported at first ends thereof to the support shaft 92, and a sub-feed roller shaft 900 is rotatably mounted to second ends of the feed roller arms 97. The sub-feed roller shaft 900 has coaxially fixed thereon three sub-feed rollers 90. The feed roller arms 97 are biased by torsion springs (not shown) in the clockwise direction as seen in FIG. 5, so that the sub-feed rollers 90 are urged in a direction to come into contact with corresponding second main feed rollers 85 through respective openings 99*c* formed in the upper guide 99. The sub-feed rollers 90 are therefore normally kept in contact with corresponding second main feed rollers 85.

The cut sheet feeding mechanism further includes a cut sheet insertion detection lever 101 and a cut sheet position detection lever 104. The cut sheet insertion detection lever 101 is rotatably supported on a shaft 102 for rotation about the shaft 102. The shaft 102 is secured to the lower guide 98. A first arm 101*a* of the cut sheet insertion detection lever 101 passes through an opening 98*d* in the lower guide 98 and an opening 99*d* in the upper guide 99 and a second arm 101*b* passes between a light-emitting element and a photosensitive element (not specifically shown) of a photoelectric sensor 103 mounted on the control printed-circuit board 83. When a cut sheet is inserted through the opening 40 into the cut sheet traveling passage 200, the tip of the first arm 101*a* of the cut sheet detection lever 101 is pushed by the front edge of the cut sheet and the lever 101 is rotated counterclockwise as seen in FIG. 2, and the second arm 101*b* moves out of the space between the light-emitting element and the photosensitive element of the photoelectric sensor 103. In response, the photoelectric sensor 103 generates a cut sheet front edge detection signal CS, which is supplied to the controller 150, as shown in FIG. 10. Thus, the insertion of the cut sheet is detected.

The cut sheet position detection lever 104 is rotatably supported on a shaft 105, for rotation about the shaft 105. The shaft 105 is secured to the lower guide 98. A first arm 104*a* of the cut sheet position detection lever 104 passes through an opening 98*e* in the lower guide 98 and an opening 99*e* in the upper guide 99. It is so arranged that in normal condition, the tip of the first arm 104*a* of the cut sheet position detection lever 104 is near and at a predetermined distance from the printing head 3. A second arm 104*b* passes through a light-emitting element and a photosensitive element (not specifically shown) of a photoelectric sensor 106, which is also mounted on the control printed-circuit board 83. When the front edge of the cut sheet hits the upper end of the first arm 104*a* of the cut sheet position detection lever 104, the cut sheet position detection lever 104 is turned clockwise as seen in FIG. 2, so that the second arm of the position detection lever 104 moves out of the space between the light-emitting element and the photosensitive element of the photoelectric sensor 106. In response, the photoelectric sensor 106 generates a cut sheet front edge detection signal ES, which is supplied to the controller 150, as shown in FIG. 10. Thus, approach of the front edge of the cut sheet to the printing head 3 is detected.

The printer is further provided with a cut sheet discharging mechanism which includes three cut sheet discharging rollers 110*a*, and three cut sheet discharging sub-rollers 114*a*. The cut sheet discharging rollers 110*a* are secured on a cut sheet discharging roller shaft 110 which is rotatably supported at opposite ends thereof to the right side frame 50 and the left side frame 51. The cut sheet discharging roller shaft 110 is provided at its right hand end with a driven gear 111, which engages platen gear 58 through an idle gear 113. On the other hand, the cut sheet discharging sub-rollers 114*a* are mounted on a cut sheet discharging sub-roller shaft 114 which is rotatably mounted at opposite ends thereof to the right side frame 50 and the left side frame 51 in such a manner that the cut sheet discharging sub-rollers 114*a* come into contact with the corresponding cut sheet discharging rollers 110*a*. The receipt sheet 55 and the journal sheet 56 are narrower than the spacings between adjacent cut sheet discharging rollers 110*a*, and are positioned between the adjacent cut sheet discharging rollers 110*a*. Accordingly, they do not receive any feeding force from the cut sheet discharging rollers 110*a*, and are therefore not fed thereby.

For simultaneously printing on both the receipt sheet 55 and the journal sheet 56, the second stepping motor 79 is energized to turn the feed/stop control cams 74 to the first position shown in FIG. 3 and FIG. 4C. In this position, the feed/stop control cams 74 push the cam follower shafts 71R and 71J of the clamp arm brackets 68 of the receipt feed/stop mechanism 67R and the journal feed/stop mechanism 67J. The friction pads 70R and 70J on the clamp arm brackets 68 are therefore separated from the beam 115, as shown in FIG. 2, and the receipt tape pressure roller 62R and the journal tape pressure roller 62J are pressed against the platen 57 to hold the receipt sheet 55 and the journal sheet 56 on the platen 57. In this condition, the first stepping motor 59 is energized to rotate the platen 57 through the gear train to feed both the receipt sheet 55 and the journal sheet 56, and thus printing on the receipt sheet 55 and the journal sheet 56 is conducted by the printing head 4.

When the second stepping motor 79 is activated to turn the feed/stop control cams 74 90° in the clockwise direction to place the feed/stop control cams 74R and 74J in the second position 74 shown in FIG. 4D, and the feed/stop mechanism in the state shown in FIG. 2, the receipt tape pressure roller 62R is kept pressed against the platen 57, and the friction pad 70R of the receipt feed/stop mechanism 67R is kept separated from the beam 115. On the other hand, the journal tape pressure roller 62J is separated from the platen 57, and the friction pad 70J of the journal feed/stop mechanism 67J is pressed against the beam 115. As a result, the receipt sheet 55 is fed while the journal sheet is halted.

In this state, the carriage 1 is moved so that the printing head 3 scans within the width of the receipt sheet 55 to print on the receipt sheet 55, and the printed receipt sheet 55 is moved upwards by the platen 57. Thus, the receipt sheet 55 is printed and fed upwards while feeding of the journal sheet 56 is stopped.

To print on the journal sheet 56 only, (with the feeding of and the printing on the receipt sheet 55 interrupted), the feed/stop control cams 74R and 74J are rotated to assume the fourth position shown in FIG. 4B, with the feed/control mechanism assuming the state shown in FIG. 7A and FIG. 7B. In this state, the journal pressure roller 62J is pressed against the platen 57, and the friction pad 70J of the journal feed/stop mechanism 67J is separated from the beam 115. On the other hand, the receipt tape pressure roller 62R is separated from the platen 57, and the friction pad 70R of the receipt feed/stop mechanism 67R is pressed against the beam 115. As a result, the journal sheet is fed while the receipt sheet is halted. The carriage 1 is moved so that the printing head 3 scans within the width of the journal sheet 55, and the printed journal sheet 55 is moved rearward and wound on the take-up reel.

Printing on a cut sheet is carried out as follows: When a cut sheet 201 is inserted through the opening 40 into the cut sheet traveling passage 200, this is detected by the combination of the cut sheet insertion detection lever 101 and the photoelectric sensor 103. Then, the second stepping motor 79 is energized to turn the feed/stop control cams 74R and 74J so that the cams 74R and 74J assume the third position shown in FIG. 4A and the feed/stop mechanisms 67R and 67J assume the states shown in FIG. 8. In this states, the pressure rollers 62R and 62J are both separated from the platen 57, and the friction pads 70R and 70J of both the receipt feed/stop mechanism 67R and the journal feed/stop mechanism 67J are pressed against the beam 115, so feeding of the receipt sheet 55 and the journal sheet 56 is halted.

Simultaneously, the cut sheet feeder clamp cams 95 are rotated such that sub-feed rollers 89 are lowered by the biasing springs 93 to come into contact with corresponding main feed rollers 84. Thus, the cut sheet 201 is held between main feed rollers 84 and sub-feed rollers 89. In this condition, the first stepping motor 59 is activated to rotate the main feed rollers 84 and the second main feed rollers 85. Thus, the cut sheet 201 is fed first by both the main feed rollers 84 and the sub-feed rollers 89 and then also by the second main feed rollers 85 and the sub-feed rollers 90.

When the front edge of the cut sheet 201 approaches the printing head 3, this is detected by the combination of the cut sheet position detection lever 104 and the photoelectric sensor 106. When the cut sheet front edge detection signal ES is produced, the controller 150 activates the first stepping motor 59 to feed the cut sheet 201 a predetermined distance over both the receipt sheet 55 and journal sheet 56 on the platen 57, i.e., between the printing head 3 and the uncut sheets 55 and 56, to position the cut sheet 201 at a printing position, and then printing is conducted. The front edge of the cut sheet 201 is held between the cut sheet discharging rollers **110*a* and the cut sheet discharging sub-rollers 114*a* as shown in FIG. 9. The cut sheet discharging rollers 110*a* and the cut sheet discharging sub-rollers 114*a* are rotated by the first stepping motor 59 during feeding of the cut sheet 201, and discharge the cut sheet 201**.

When the cut sheet is discharged, the cut sheet insertion detection lever 101 and the cut sheet position detection lever 104 detect the absence of the cut sheet. The detection of the absence of the cut sheet is reflected by the signals CS and ES. In response, the controller actuates the stepping motor to return the feed/stop mechanism to the original position, i.e., the position it assumed before the insertion of the cut sheet.

Figure 5:
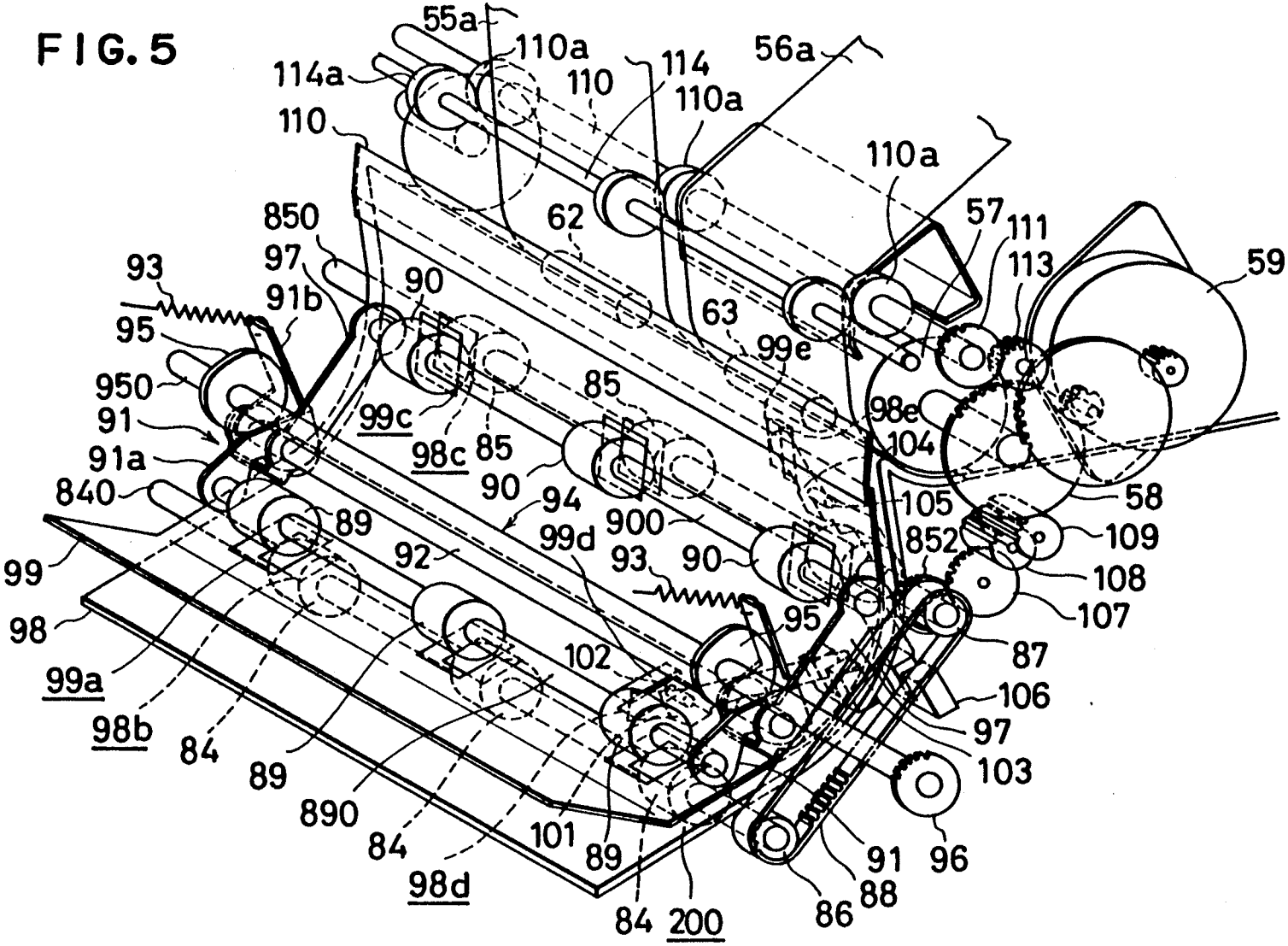
FIG. 5 is an enlarged perspective view of a cut sheet feeding mechanism in FIG. 1.
Figure 11:
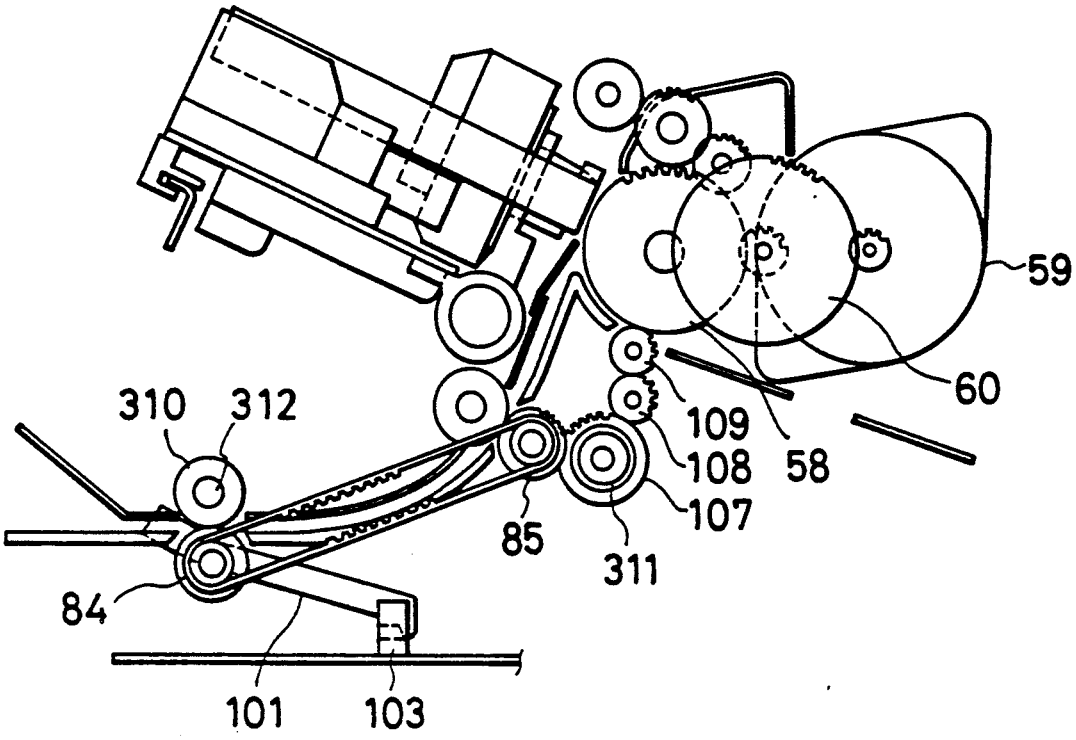
FIG. 11 is a side view of a modified form of the cut sheet feeding mechanism of FIG. 5.

A second embodiment of the cut sheet feeding mechanism of FIG. 5 is illustrated in FIG. 11, in which like reference numerals designate corresponding parts of the printer of the preceding embodiment and descriptions thereof are omitted. In this modified cut sheet feeding mechanism, each of the main feed rollers 84 always contact respective sub-feed rollers 310 (only one of which is shown) which are fixed on a shaft 312 rotatably mounted at opposite ends thereof to the right side frame 50 and the left side frame 51. The idle gear 107 transmits a driving force from the first stepping motor 59 to the main feed rollers 84 and second main feed rollers 85. An electromagnetic clutch 311 is provided to selectively connect or disconnect the idle gear 107 to and from the idle gear 108.

The electromagnetic clutch 311 is disengaged by the controller 150 when one or both of the receipt sheet 55 and the journal sheet 56 are printed. When a cut sheet is inserted for printing, the insertion is detected by the cut sheet insertion detection lever 101, the photoelectric sensor 103, and the controller 150, in the same way as described before, the controller 150 actuates the second stepping motor 79 to place the feed/stop control cams 74R and 74J in the third position shown in FIG. 4A to stop the feeding of both the receipt sheet 55 and the journal sheet 56. Simultaneously, the electromagnetic clutch 311 is engaged, while the first stepping motor 59 is kept activated. Because of the engagement of the electromagnetic clutch 311, the feed rollers are rotated and the cut sheet is therefore fed. Thus, the cut sheet 201 is printed by the printing head 3.

Figure 12:
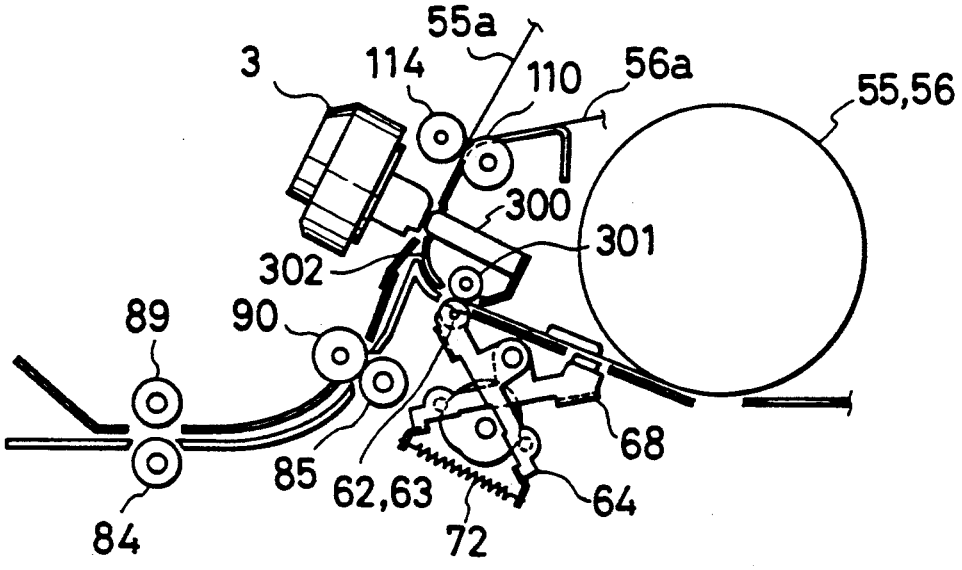
FIG. 12 is a side view, on a reduced scale of a modified form of the uncut sheet feeding apparatus of FIG. 2.
Figure 13:
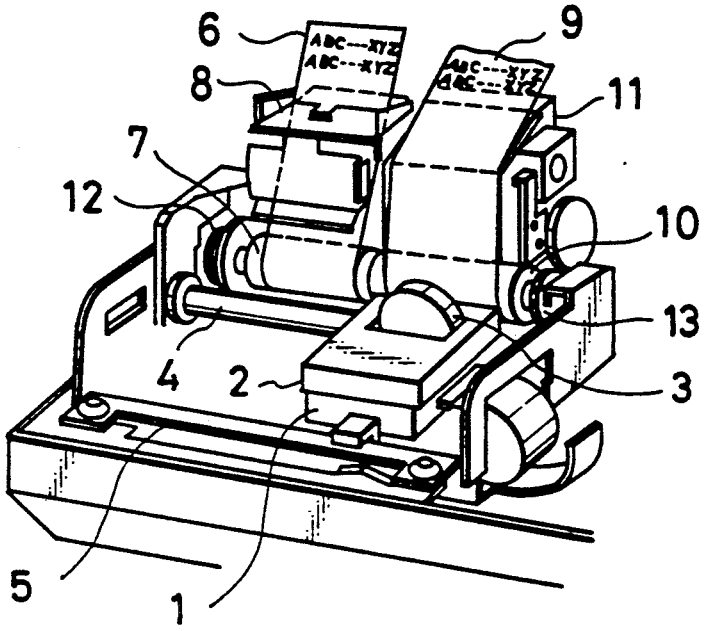
FIG.13 PRIOR ART
FIG. 13 is a perspective view of an ECR printer of the prior art.
Figure 14:
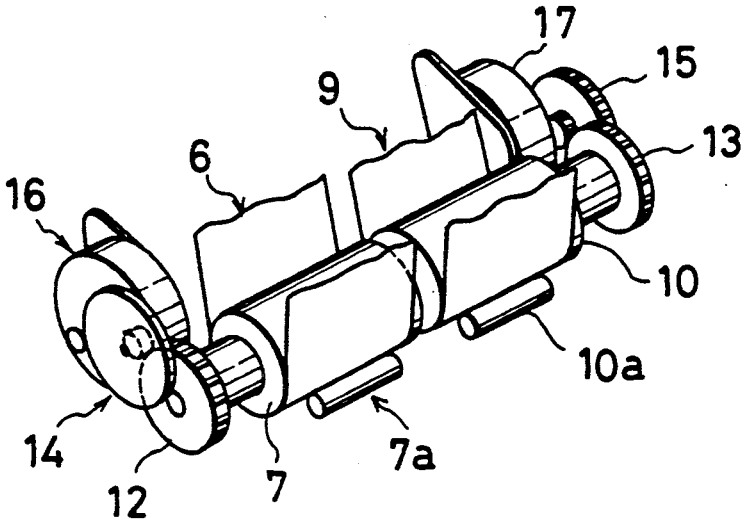
FIG.14 PRIOR ART
FIG. 14 is an enlarged perspective view of receipt sheet and journal sheet feeding mechanisms of FIG. 13.

A modification of the uncut sheet feeding mechanism of FIG. 2 is shown in FIG. 12, in which like reference numerals also indicate corresponding parts of the uncut sheet feeding mechanism in FIG. 2 and descriptions thereof are omitted. In FIG. 12, reference numeral 300 designates a fixed flat platen secured at opposite ends thereof (not shown) to the right side frame 50 and the left side frame 51. In place of the platen 57, an uncut sheet feed roller 301 is arranged to contact the receipt tape pressure roller 62R and the journal tape pressure roller 62J. The uncut sheet feed roller 301 is rotatably supported at opposite ends thereof to the right side frame 50 and the left side frame 51. Although not shown, a platen gear 58 is secured to one end of the uncut sheet feed roller 301 so that the uncut sheet feed roller 301 is rotated by the first stepping motor 59 through the gear train, as with the platen 57 in FIG. 1.

An uncut sheet guide member 302 is provided downstream of the uncut sheet feed roller 301 for guiding the receipt sheet 55 and the journal sheet 56. In this modification, the receipt sheet 55 and journal sheet 56 are held between the uncut sheet feed roller 301 and pressure rollers 62R, 62J, and fed forwardly.

Although in the preceding embodiments, the printer prints on both the receipt sheet 55 and the journal sheet 56, the present invention may be applied to a printer for printing on only one uncut sheet. In such a printer, only one roll of an uncut sheet is provided.

What is claimed is:

1. A printer capable of selectively printing on an uncut receipt sheet, an uncut journal sheet, or a cut sheet, said printer comprising:

a frame;

a platen roller rotatably mounted on said frame;

a printing head mounted to confront said platen roller and spaced therefrom by a gap;

a motor;

a receipt sheet feed/stop mechanism for selectively feeding a receipt sheet from a roll of receipt sheet to said gap between said printing head and said platen roller or for halting such feeding, said receipt sheet feed/stop mechanism comprising a pressure roller and an actuating means for actuating said pressure roller between a first position at which said pressure roller is pressed toward said platen roller to feed the receipt sheet and a second position at which said pressure roller is separated from said platen roller;

a journal sheet feed/stop mechanism for selectively feeding a journal sheet from a roll of journal sheet to said gap between said printing head and said platen roller or for halting such feeding, said journal sheet feed/stop mechanism comprising a pressure roller and an acutating means for actuating said pressure roller between a first position at which said pressure roller is pressed toward said platen roller to feed the journal sheet and a second position at which said pressure roller is separated from said platen roller;

said receipt sheet feed/stop mechanism and said journal sheet feed/stop mechanism being driven independently of each other by said motor to feed the receipt and journal sheets independently of each other in paths side-by-side over said platen roller;

a cut sheet feeding mechanism for feeding a cut sheet to a gap between said printing head and the receipt and journal sheets on said platen roller;

said cut sheet feeding mechanism being driven by said motor to feed the cut sheet;

said roller platen roller having a continuous and uninterrupted surface extending laterally over the entire width of the cut sheet and the uncut sheets; and control means, operatively connected to said motor, for controlling said receipt sheet feed/stop mechanism, said journal sheet feed/stop mechanism, and said cut sheet feeding mechanism so as not to feed the cut sheet when at least one of the receipt sheet and the journal sheet is fed, and not to feed the receipt sheet or the journal sheet when the cut sheet is fed.

2. The printer according to claim 1, further comprising detecting means for detecting insertion of a cut sheet, said control means being operatively connected to said detecting means and responsive to said detecting means for, upon said detecting means detecting insertion of a cut sheet, causing said cut sheet feeding mechanism to feed the inserted cut sheet and causing said receipt sheet feed/stop mechanism and said journal sheet feed/stop mechanism to halt feeding.

3. The printer according to claim 1, further comprising discharge rollers mounted coaxially on a discharge roller shaft and disposed downstream of said printing head at a part where the receipt and journal sheets and the cut sheet are superimposed, adjacent said discharge rollers being spaced by a distance greater than the width of the receipt sheet or the journal sheet such that the receipt sheet and journal sheet are positioned laterally to pass between said adjacent discharge rollers so that they are not fed by said discharge rollers, whereas the width of the cut sheet is greater than the spacing between said adjacent discharge rollers and the cut sheet is positioned laterally to be fed by said discharge rollers.

4. The printer according to claim 1, wherein said cut sheet feeding mechanism comprises a pair of feed rollers, and actuating means for pressing said feed rollers against each other for feeding the cut sheet.

5. The printer according to claim 4, further comprising means for detecting the insertion of a cut sheet, wherein said actuating means actuating said feed rollers against each other when the insertion of a cut sheet is detected.

6. The printer according to claim 1, further comprising a beam extending parallel with the axis of said platen roller and positioned adjacent to said platen roller, wherein said receipt sheet feed/stop mechanism includes a friction pad, said actuating means thereof is operable to selectively separate said friction pad from said beam when said pressure roller is pressed toward said platen roller and to press said friction pad against said beam to hold the receipt sheet when said pressure roller is separated from said platen roller; and said journal sheet feed/stop mechanism includes a friction pad, said actuating means thereof is operable to selectively separate said friction pad from said beam when said pressure roller is pressed toward said platen roller and to press said friction pad against said beam to hold the journal sheet when said pressure roller is separated from said platen roller.

7. The printer according to claim 6, wherein said actuating means of each of said receipt sheet feed/stop mechanism and said journal sheet stop/feed mechanism comprises:

a pressure roller arm bracket having a first end rotatably supporting said pressure roller, a rotatably supported intermediate part, and a second end supporting a first cam follower shaft;

a clamp arm bracket having a first end supporting said friction pad, a rotatably supported intermediate part, and a second end supporting a second cam follower shaft;

a tension spring connecting said second ends of said pressure roller arm bracket and said clamp arm bracket for pulling said second ends toward each other; and a cam for engaging said first and second cam follower shafts for actuating said pressure roller and said friction pad said cam being selectively rotatably between a first position pushing said second cam follower shaft to thereby cause said friction pad to separate from said beam and said pressure roller to be pressed toward said platen roller, and a second position pushing said first cam follower shaft to thereby cause said pressure roller to separate from said platen roller and said friction pad to be pressed against said beam.

8. The printer according to claim 7, further comprising an additional motor for driving said cams of said actuating means of said receipt sheet feed/stop mechanism and said journal sheet feed/stop mechanism.

* * * * *